US008438893B2

(12) United States Patent
Durney et al.

(10) Patent No.: US 8,438,893 B2
(45) Date of Patent: May 14, 2013

(54) METHOD OF FORMING TWO-DIMENSIONAL SHEET MATERIAL INTO THREE-DIMENSIONAL STRUCTURE

(75) Inventors: Max W. Durney, San Francisco, CA (US); Radha Vaidyanathan, Los Altos, CA (US); Ryan Lam, San Mateo, CA (US)

(73) Assignee: Industrial Origami, Inc., Middleburg Heights, OH (US)

( * ) Notice: Subject to any disclaimer, the term of this patent is extended or adjusted under 35 U.S.C. 154(b) by 245 days.

(21) Appl. No.: 12/871,494

(22) Filed: Aug. 30, 2010

(65) Prior Publication Data

US 2011/0049166 A1 Mar. 3, 2011

Related U.S. Application Data

(62) Division of application No. 11/925,195, filed on Oct. 26, 2007, now abandoned.

(60) Provisional application No. 60/854,846, filed on Oct. 26, 2006, provisional application No. 60/974,473, filed on Sep. 23, 2007.

(51) Int. Cl.
*B21D 43/28* (2006.01)

(52) U.S. Cl.
USPC ..... 72/324; 72/325; 72/332

(58) Field of Classification Search ..... 72/324, 72/325, 332, 335, 379.2
See application file for complete search history.

(56) References Cited

U.S. PATENT DOCUMENTS

| | | | |
|---|---|---|---|
| 387,651 | A | 8/1888 | Maxim |
| 624,144 | A | 5/1899 | Wilmot |
| 649,387 | A | 5/1900 | Wright et al. |

(Continued)

FOREIGN PATENT DOCUMENTS

| | | |
|---|---|---|
| CA | 1233304 | 3/1988 |
| CA | 2419225 | 6/2009 |

(Continued)

OTHER PUBLICATIONS

"Hold the Press", Eureka Magazine, Aug. 2007, vol. 27, No. 8, Findlay Publications Ltd., Darford Kent UK, pp. 12-13.

(Continued)

*Primary Examiner* — Dana Ross
*Assistant Examiner* — Homer Boyer
(74) *Attorney, Agent, or Firm* — K&L Gates, LLP

(57) ABSTRACT

A two-dimensional sheet material is provided that is suitable for bending along a bend line to form a three-dimensional object. The sheet material is provided with a plurality of displacements in a thickness direction of the sheet material on one side of the bend line. A portion of the displacements shear adjacent the bend line and define an edge and an opposed face. The edge and opposed face configured to produce edge-to-face engagement of the sheet material during bending. Alternatively, sheet material is provided with a plurality of displacements in a thickness direction of the sheet material on one or both sides of the bend line, and with a plurality of corresponding and cooperating protrusions to improve structural integrity and/or to improve electromagnetic and radio frequency shielding. The sheet material may also be provided with a self-latching structure. A method of preparing and using these sheet materials is also described.

10 Claims, 9 Drawing Sheets

U.S. PATENT DOCUMENTS

| | | | |
|---|---|---|---|
| 649,762 | A | 5/1900 | Saltzkorn et al. |
| 800,365 | A | 9/1905 | Ebert |
| 975,121 | A | 11/1910 | Carter |
| 1,295,769 | A | 2/1919 | Kux |
| 1,405,042 | A | 1/1922 | Kraft |
| 1,468,271 | A | 9/1923 | Bechtel |
| 1,557,066 | A | 10/1925 | Krantz |
| 1,698,891 | A | 1/1929 | Overbury |
| 1,699,693 | A | 1/1929 | Eisenhauer |
| 1,810,842 | A | 9/1929 | Moecker, Jr. |
| 1,746,429 | A | 2/1930 | Kelleweay |
| 2,127,618 | A | 8/1938 | Riemenschneider |
| 2,158,972 | A | 5/1939 | Weindel, Jr. |
| 2,339,355 | A | 1/1944 | Rutten |
| 2,423,863 | A | 7/1947 | Wales |
| 2,480,034 | A | 8/1949 | Lapp |
| 2,484,398 | A | 10/1949 | Bell et al. |
| 2,512,118 | A | 7/1950 | Snow |
| 2,515,067 | A | 7/1950 | Wright et al. |
| 2,560,786 | A | 7/1951 | Wright et al. |
| 2,625,290 | A | 1/1953 | Kice et al. |
| 2,638,643 | A | 5/1953 | Miller |
| 2,771,851 | A | 11/1956 | McGregor |
| 2,825,407 | A | 3/1958 | Widell |
| 2,869,694 | A | 1/1959 | Breckheimer |
| 2,880,032 | A | 3/1959 | Bareenyl |
| 2,882,990 | A | 4/1959 | Mustoe |
| 2,901,155 | A | 8/1959 | Vines |
| 2,916,181 | A | 12/1959 | Pfister et al. |
| 2,926,831 | A | 3/1960 | Strange |
| 2,948,624 | A | 8/1960 | Watson et al. |
| 2,976,747 | A | 3/1961 | Schatzschock et al. |
| 3,039,414 | A | 6/1962 | Rosanes |
| 3,090,087 | A | 5/1963 | Miller |
| 3,094,158 | A | 6/1963 | Reid |
| 3,094,229 | A | 6/1963 | Johnson et al. |
| 3,095,134 | A | 6/1963 | Jacke |
| 3,107,041 | A | 10/1963 | Wagner, Jr. |
| 3,107,807 | A | 10/1963 | Bergh et al. |
| 3,120,257 | A | 2/1964 | Webers et al. |
| 3,135,527 | A | 6/1964 | Knapp |
| 3,156,232 | A | 11/1964 | Pollock et al. |
| 3,159,156 | A | 12/1964 | Incledon |
| 3,191,564 | A | 6/1965 | Fraze |
| 3,216,644 | A | 11/1965 | Harrison et al. |
| 3,217,437 | A | 11/1965 | Cobb |
| 3,228,710 | A | 1/1966 | Chodorowski |
| 3,258,380 | A | 6/1966 | Fischer et al. |
| 3,313,080 | A | 4/1967 | Gewiss |
| 3,318,301 | A | 5/1967 | Schibley |
| 3,341,395 | A | 9/1967 | Weber |
| 3,353,639 | A | 11/1967 | Andriussi |
| 3,357,078 | A | 12/1967 | Moltchan |
| 3,361,320 | A | 1/1968 | Bobrowski |
| 3,455,018 | A | 7/1969 | Collins |
| 3,474,225 | A | 10/1969 | Leedy |
| 3,521,536 | A | 7/1970 | Waldbauer et al. |
| 3,538,982 | A | 11/1970 | Fiori |
| 3,590,759 | A | 7/1971 | Hendrie, Jr. et al. |
| 3,626,604 | A | 12/1971 | Pierce |
| 3,638,465 | A | 2/1972 | Lickliter et al. |
| 3,638,597 | A | 2/1972 | Brown |
| 3,666,607 | A | 5/1972 | Weissman |
| 3,688,385 | A | 9/1972 | Brown |
| 3,717,022 | A | 2/1973 | DuBois |
| 3,731,514 | A | 5/1973 | Deibele, Jr. |
| 3,756,499 | A | 9/1973 | Giebel et al. |
| 3,774,434 | A | 11/1973 | Bock |
| 3,779,282 | A | 12/1973 | Klees |
| 3,788,934 | A | 1/1974 | Coppa |
| 3,851,912 | A | 12/1974 | Grosseau |
| 3,854,859 | A | 12/1974 | Sola |
| 3,862,562 | A | 1/1975 | Kruger |
| 3,867,829 | A | 2/1975 | Bock |
| 3,878,438 | A | 4/1975 | Weisman |
| 3,879,240 | A | 4/1975 | Wall |
| 3,882,653 | A | 5/1975 | Ollman |
| 3,890,869 | A | 6/1975 | Van Cleave |
| 3,907,193 | A | 9/1975 | Heller |
| 3,914,974 | A | 10/1975 | De Vore |
| 3,938,657 | A | 2/1976 | David |
| 3,943,744 | A | 3/1976 | Marsh et al. |
| 3,952,574 | A | 4/1976 | Speidel |
| 3,963,170 | A | 6/1976 | Wood |
| 3,994,275 | A | 11/1976 | Williams |
| 4,004,334 | A | 1/1977 | Greenley |
| 4,011,704 | A | 3/1977 | O'Konski |
| 4,027,340 | A | 6/1977 | Hadtke |
| 4,058,813 | A | 11/1977 | Risko |
| 4,102,525 | A | 7/1978 | Albano |
| 4,120,084 | A | 10/1978 | Wallman |
| 4,132,026 | A | 1/1979 | Dodds |
| 4,133,198 | A | 1/1979 | Huda et al. |
| 4,133,336 | A | 1/1979 | Smith |
| 4,141,525 | A | 2/1979 | Miller |
| 4,145,801 | A | 3/1979 | Schrecker et al. |
| 4,166,565 | A | 9/1979 | Webinger |
| 4,170,691 | A | 10/1979 | Rogers |
| 4,190,190 | A | 2/1980 | Halonen |
| 4,215,194 | A | 7/1980 | Shepherd |
| 4,230,058 | A | 10/1980 | Iwaki et al. |
| 4,245,615 | A | 1/1981 | Moss |
| 4,289,290 | A | 9/1981 | Miller |
| 4,327,835 | A | 5/1982 | Leger |
| 4,352,843 | A | 10/1982 | Eckert |
| 4,362,519 | A | 12/1982 | Gault |
| 4,383,430 | A | 5/1983 | Klaus |
| 4,401,341 | A | 8/1983 | Hirabayashi et al. |
| 4,428,599 | A | 1/1984 | Jahnle |
| 4,457,555 | A | 7/1984 | Draper |
| 4,468,946 | A | 9/1984 | Driear |
| 4,469,273 | A | 9/1984 | Smith |
| 4,469,727 | A | 9/1984 | Loew |
| 4,479,737 | A | 10/1984 | Bergh et al. |
| 4,489,976 | A | 12/1984 | Flaherty |
| 4,491,362 | A | 1/1985 | Kennedy |
| 4,510,785 | A | 4/1985 | Triouleyre et al. |
| 4,515,004 | A | 5/1985 | Jaenson |
| 4,542,933 | A | 9/1985 | Bischoff |
| 4,557,132 | A | 12/1985 | Break |
| 4,558,582 | A | 12/1985 | Meinig |
| 4,559,259 | A | 12/1985 | Cetrelli |
| 4,597,374 | A | 7/1986 | Igarashi |
| 4,628,661 | A | 12/1986 | St. Louis |
| 4,645,701 | A | 2/1987 | Zarrow |
| 4,650,217 | A | 3/1987 | Ehrlund |
| 4,672,718 | A | 6/1987 | Schlueter et al. |
| 4,676,545 | A | 6/1987 | Bonfilio et al. |
| 4,735,077 | A | 4/1988 | Döring et al. |
| 4,760,634 | A | 8/1988 | Rapp et al. |
| 4,792,082 | A | 12/1988 | Williamson |
| 4,803,879 | A | 2/1989 | Crawford |
| 4,819,792 | A | 4/1989 | Christian |
| 4,831,711 | A | 5/1989 | Rapp |
| 4,837,066 | A | 6/1989 | Quinn et al. |
| 4,869,539 | A | 9/1989 | Cassese |
| 4,887,862 | A | 12/1989 | Bassi |
| 4,898,326 | A | 2/1990 | Edwards et al. |
| 4,950,026 | A | 8/1990 | Emmons |
| 4,951,967 | A | 8/1990 | Michalik |
| 5,022,804 | A | 6/1991 | Peterson |
| 5,077,601 | A | 12/1991 | Hatada et al. |
| 5,105,640 | A | 4/1992 | Moore et al. |
| 5,148,600 | A | 9/1992 | Chen et al. |
| 5,148,900 | A | 9/1992 | Mohan |
| 5,157,852 | A | 10/1992 | Patrou et al. |
| 5,195,644 | A | 3/1993 | Schmid |
| 5,205,476 | A | 4/1993 | Sorenson |
| 5,211,047 | A | 5/1993 | Kaneyuki |
| 5,211,330 | A | 5/1993 | Frey |
| 5,225,799 | A | 7/1993 | West et al. |
| 5,227,176 | A | 7/1993 | McIntyre-Major |
| 5,234,246 | A | 8/1993 | Henigue et al. |
| 5,234,727 | A | 8/1993 | Hoberman |
| 5,239,741 | A | 8/1993 | Shamos |
| 5,255,969 | A | 10/1993 | Cox et al. |
| 5,259,100 | A | 11/1993 | Takahashi |

5,262,220 A 11/1993 Spriggs et al.
5,284,043 A 2/1994 Hayashi
5,297,836 A 3/1994 Parry-Williams
5,302,435 A 4/1994 Hashimoto
5,316,165 A 5/1994 Moran, Jr.
5,333,519 A 8/1994 Holliday et al.
5,362,120 A 11/1994 Cornille, Jr.
5,372,026 A 12/1994 Roper
5,377,519 A 1/1995 Hayashi
5,378,172 A * 1/1995 Roberts ..... 439/607.26
5,390,782 A 2/1995 Sinn
5,392,629 A 2/1995 Goss et al.
5,415,021 A 5/1995 Folmer
5,427,732 A 6/1995 Shuert
5,432,989 A 7/1995 Turek
5,440,450 A 8/1995 Lau et al.
5,460,773 A 10/1995 Fritz et al.
5,466,146 A 11/1995 Fritz et al.
5,475,911 A 12/1995 Wells et al.
5,496,067 A 3/1996 Stoll et al.
5,497,825 A 3/1996 Yu
5,524,396 A 6/1996 Lalvani
5,533,444 A 7/1996 Parks
5,545,026 A 8/1996 Fritz et al.
5,568,680 A 10/1996 Parker
5,571,280 A 11/1996 Lehrer
5,587,914 A 12/1996 Conradson et al.
5,592,363 A 1/1997 Atarashi et al.
5,619,784 A 4/1997 Nishimoto et al.
5,620,623 A 4/1997 Baker
5,630,469 A 5/1997 Butterbaugh et al.
5,640,046 A 6/1997 Suzuki et al.
5,660,365 A 8/1997 Glick
5,679,388 A 10/1997 Fritz et al.
5,692,672 A 12/1997 Hunt
5,701,780 A 12/1997 Ver Meer
5,704,212 A 1/1998 Erler et al.
5,709,913 A 1/1998 Andersen et al.
5,725,147 A 3/1998 Ljungstrom et al.
5,737,226 A 4/1998 Olson et al.
5,740,589 A 4/1998 Dominguez
5,789,050 A 8/1998 Kang
5,828,575 A 10/1998 Sakai
5,882,064 A 3/1999 Emmons
5,885,676 A 3/1999 Lobo et al.
5,932,167 A 8/1999 Fritz et al.
6,021,042 A 2/2000 Anderson et al.
6,055,788 A 5/2000 Martin et al.
6,065,323 A 5/2000 Arduino et al.
6,071,574 A 6/2000 Weder
6,132,349 A 10/2000 Yokoyama
6,144,896 A 11/2000 Kask et al.
6,158,652 A 12/2000 Ruiz et al.
6,194,653 B1 2/2001 McMiller et al.
6,210,037 B1 4/2001 Brandon, Jr.
6,210,623 B1 4/2001 Fritz et al.
6,220,654 B1 4/2001 Sommer
6,233,538 B1 5/2001 Gupta et al.
6,279,288 B1 8/2001 Keil
6,296,300 B1 10/2001 Sato
6,296,301 B1 10/2001 Schroeder et al.
6,299,240 B1 10/2001 Schroeder et al.
6,330,153 B1 12/2001 Ketonen et al.
6,373,696 B1 4/2002 Bolognia et al.
6,386,009 B1 5/2002 Ni et al.
6,391,424 B1 5/2002 Suzuki
6,400,012 B1 6/2002 Miller et al.
6,412,325 B1 7/2002 Croswell
6,467,475 B2 10/2002 Leutner et al.
6,481,259 B1 11/2002 Durney
6,490,498 B1 12/2002 Takagi
6,558,775 B1 5/2003 Suzuki
6,588,244 B2 7/2003 Chevalier
6,592,174 B1 7/2003 Rollin et al.
6,599,601 B2 7/2003 Fogle et al.
6,626,560 B1 9/2003 Caferro et al.
6,631,630 B1 10/2003 Pourboghrat et al.
6,640,599 B1 11/2003 Persson
6,640,605 B2 11/2003 Gitlin et al.
6,643,561 B1 11/2003 Torvinen
6,647,693 B2 11/2003 Bromberg
6,648,159 B2 11/2003 Prutkin et al.
6,658,316 B1 12/2003 Mehta et al.
6,677,562 B2 1/2004 Oshima et al.
6,688,043 B1 2/2004 Feder et al.
6,722,013 B1 4/2004 Rapp
6,728,114 B2 4/2004 Serjack et al.
6,745,608 B2 6/2004 Miura
6,761,502 B2 7/2004 Bishop et al.
6,805,566 B2 * 10/2004 Chia-Chen ..... 439/188
6,821,606 B2 11/2004 Suzuki
6,831,255 B1 12/2004 Levi et al.
6,837,334 B1 1/2005 Le Prevost
6,844,050 B2 1/2005 Noilhan
6,868,708 B2 3/2005 Carlsson et al.
6,877,349 B2 4/2005 Durney et al.
6,917,017 B2 7/2005 Moon et al.
6,936,795 B1 8/2005 Moon et al.
6,940,716 B1 9/2005 Korinsky et al.
6,941,786 B1 9/2005 Cooper et al.
6,986,273 B2 1/2006 Rager
7,000,978 B1 2/2006 Messano
7,014,174 B2 3/2006 Roberts et al.
7,032,426 B2 4/2006 Durney et al.
7,051,768 B2 5/2006 Takahashi
7,069,758 B2 7/2006 Kariakin et al.
7,099,154 B2 8/2006 Ishiyama
7,099,160 B1 8/2006 Ice
7,126,819 B2 10/2006 Liang
7,140,672 B2 11/2006 Chernoff et al.
7,152,449 B2 12/2006 Durney et al.
7,152,450 B2 12/2006 Durney et al.
7,156,200 B2 1/2007 Dershem et al.
7,167,380 B2 1/2007 Ice
7,185,934 B2 3/2007 Saeki
7,222,511 B2 5/2007 Durney et al.
7,225,542 B2 6/2007 Chernoff et al.
7,243,519 B1 7/2007 Chuang
7,263,869 B2 9/2007 Durney et al.
7,264,304 B2 9/2007 Carcioffi
7,275,403 B2 10/2007 Meyer
7,281,754 B2 10/2007 Behr
7,296,455 B2 11/2007 Durney
7,331,505 B2 2/2008 Holley, Jr.
7,350,390 B2 4/2008 Durney et al.
7,354,639 B2 4/2008 Durney et al.
7,374,810 B2 5/2008 Durney et al.
7,412,865 B2 8/2008 Durney
7,440,874 B2 10/2008 Durney et al.
7,464,574 B2 12/2008 Durney et al.
7,503,623 B2 3/2009 Favaretto
7,534,501 B2 5/2009 Durney
7,560,155 B2 7/2009 Durney et al.
7,640,775 B2 1/2010 Durney
2001/0010167 A1 8/2001 Leek
2002/0153371 A1 10/2002 Oshima et al.
2002/0163173 A1 11/2002 Ruehl et al.
2002/0184936 A1 12/2002 Gitlin et al.
2002/0185892 A1 12/2002 Rima et al.
2003/0037586 A1 2/2003 Durney et al.
2003/0062739 A1 4/2003 Bock
2003/0104916 A1 6/2003 Suzuki
2004/0035175 A1 2/2004 Karhumaki
2004/0076800 A1 4/2004 Noilhan
2004/0079353 A1 4/2004 Dimitrios
2004/0103707 A1 6/2004 Winters
2004/0130182 A1 7/2004 Bangle et al.
2004/0134250 A1 7/2004 Durney et al.
2004/0206152 A1 10/2004 Durney et al.
2004/0207228 A1 10/2004 Gebreselassie et al.
2005/0005670 A1 1/2005 Durney et al.
2005/0042432 A1 2/2005 Jones et al.
2005/0061049 A1 3/2005 Durney et al.
2005/0064138 A1 3/2005 Durney et al.
2005/0088014 A1 4/2005 Woodson et al.
2005/0097937 A1 5/2005 Durney et al.
2005/0117300 A1 6/2005 Prasher et al.
2005/0120766 A1 6/2005 Friedman et al.

| | | | |
|---|---|---|---|
| 2005/0126110 | A1 | 6/2005 | Durney et al. |
| 2005/0161979 | A1 | 7/2005 | Chernoff et al. |
| 2005/0167459 | A1 | 8/2005 | Storer |
| 2005/0168014 | A1 | 8/2005 | Chernoff et al. |
| 2005/0174732 | A1 | 8/2005 | Lin |
| 2005/0189790 | A1 | 9/2005 | Chernoff et al. |
| 2005/0189791 | A1 | 9/2005 | Chernoff et al. |
| 2005/0257589 | A1 | 11/2005 | Durney et al. |
| 2005/0284088 | A1 | 12/2005 | Heath |
| 2006/0021413 | A1 | 2/2006 | Durney et al. |
| 2006/0044755 | A1 | 3/2006 | Ishiyama |
| 2006/0053857 | A1 | 3/2006 | Durney |
| 2006/0059807 | A1 | 3/2006 | Zimmerman et al. |
| 2006/0061966 | A1 | 3/2006 | Korinsky et al. |
| 2006/0075798 | A1 | 4/2006 | Durney et al. |
| 2006/0096100 | A1 | 5/2006 | Stol et al. |
| 2006/0130551 | A1 | 6/2006 | Durney et al. |
| 2006/0175871 | A1 | 8/2006 | Eipper et al. |
| 2006/0181846 | A1 | 8/2006 | Farnsworth et al. |
| 2006/0207212 | A1 | 9/2006 | Durney |
| 2006/0213245 | A1 | 9/2006 | Durney |
| 2006/0232052 | A1 | 10/2006 | Breed |
| 2006/0232934 | A1 | 10/2006 | Kusamoto et al. |
| 2006/0237996 | A1 | 10/2006 | Eipper et al. |
| 2006/0261139 | A1 | 11/2006 | Durney |
| 2006/0277965 | A1 | 12/2006 | Durney |
| 2007/0113614 | A1 | 5/2007 | Durney et al. |
| 2007/0117502 | A1 | 5/2007 | Kim |
| 2007/0123113 | A1 | 5/2007 | Durney |
| 2007/0146988 | A1 | 6/2007 | Yamagishi et al. |
| 2007/0206353 | A1 | 9/2007 | Boone et al. |
| 2007/0231062 | A1 | 10/2007 | Durney |
| 2007/0241587 | A1 | 10/2007 | Fleming |
| 2007/0262128 | A1 | 11/2007 | Durney |
| 2007/0271793 | A1 | 11/2007 | Mellis et al. |
| 2007/0286722 | A1 | 12/2007 | Lan |
| 2008/0016937 | A1 | 1/2008 | Durney et al. |
| 2008/0048366 | A1 | 2/2008 | Durney |
| 2008/0054683 | A1 | 3/2008 | Takeda |
| 2008/0063834 | A1 | 3/2008 | Durney et al. |
| 2008/0098787 | A1 | 5/2008 | Durney |
| 2008/0121009 | A1 | 5/2008 | Durney et al. |
| 2008/0187427 | A1 | 8/2008 | Durney |
| 2008/0193714 | A1 | 8/2008 | Durney et al. |
| 2008/0250837 | A1 | 10/2008 | Durney |
| 2008/0271511 | A1 | 11/2008 | Durney et al. |
| 2008/0276682 | A1 | 11/2008 | Durney |
| 2009/0297740 | A1 | 12/2009 | Durney |
| 2010/0201158 | A1 | 8/2010 | Miyashita |

FOREIGN PATENT DOCUMENTS

| | | | |
|---|---|---|---|
| CN | 1292106 | | 4/2001 |
| DE | 3642208 | A1 | 6/1987 |
| DE | 3906958 | A1 | 9/1990 |
| DE | 29818909 | U1 | 2/1999 |
| DE | 19746931 | C1 | 6/1999 |
| DE | 19951850 | C1 | 1/2001 |
| EP | 0873858 | | 10/1998 |
| EP | 1529575 | A2 | 5/2005 |
| GB | 590720 | | 7/1947 |
| GB | 740933 | | 11/1955 |
| GB | 955666 | | 4/1964 |
| GB | 2054690 | * | 6/1979 |
| GB | 2 129 339 | A | 5/1984 |
| GB | 2 174 781 | A | 11/1986 |
| GB | 2197457 | A | 5/1988 |
| GB | 2427399 | A | 12/2006 |
| JP | 52-068848 | | 6/1977 |
| JP | 53-070069 | | 6/1978 |
| JP | 55-022468 | | 2/1980 |
| JP | 55-055222 | | 4/1980 |
| JP | 59-006116 | | 1/1984 |
| JP | 60061237 | A | 4/1985 |
| JP | 62094474 | A | 4/1987 |
| JP | 63134381 | A | 6/1988 |
| JP | 63263175 | A | 10/1988 |
| JP | 63263176 | A | 10/1988 |
| JP | 1-136612 | | 5/1989 |
| JP | 02-065416 | | 5/1990 |
| JP | 02-165817 | | 6/1990 |
| JP | 02-192821 | | 7/1990 |
| JP | 02-258116 | A | 10/1990 |
| JP | 02-258117 | | 10/1990 |
| JP | 04-033723 | | 2/1992 |
| JP | 04-91822 | | 3/1992 |
| JP | 05-261442 | A | 10/1993 |
| JP | 05-278634 | A | 10/1993 |
| JP | 5-337580 | | 12/1993 |
| JP | 6063756 | | 3/1994 |
| JP | 07-148528 | | 6/1995 |
| JP | 7178463 | | 7/1995 |
| JP | 08-224619 | | 9/1996 |
| JP | 8-252879 | | 10/1996 |
| JP | 09-141333 | A | 6/1997 |
| JP | 10-085837 | | 4/1998 |
| JP | 11-123458 | | 5/1999 |
| JP | 11-188426 | | 7/1999 |
| JP | 11-319952 | | 11/1999 |
| JP | 2000-198153 | | 7/2000 |
| JP | 2004-505780 | | 2/2004 |
| MX | MX/PA/05003149 | | 6/2005 |
| NL | 8900776 | A | 10/1990 |
| TW | 159771 | | 6/1991 |
| TW | 167516 | | 9/1991 |
| TW | 422735 | | 2/2001 |
| TW | 431422 | | 4/2001 |
| TW | 451893 | | 8/2001 |
| TW | 451896 | | 8/2001 |
| TW | 544356 | | 8/2003 |
| WO | WO 94/06710 | | 3/1994 |
| WO | WO 97/24221 | | 7/1997 |
| WO | WO 98/38073 | | 9/1998 |
| WO | WO 02/13991 | | 2/2002 |
| WO | WO 02/051688 | | 7/2002 |
| WO | WO 2004/028937 | | 4/2004 |
| WO | WO 2004/098810 | | 11/2004 |
| WO | WO 2005/082112 | | 9/2005 |
| WO | WO 2005/099925 | | 10/2005 |
| WO | WO 2006/036462 | | 4/2006 |
| WO | WO 2007/038154 | | 4/2007 |

OTHER PUBLICATIONS

Derwent Abstract Accession No. 1995-280162/37, M21, JP 3474242 B2 (Amada Co Ltd) Dec. 8, 2003.

Derwent Abstract Accession No. 1999-340844/29, P52, JP 11 123458 A (Meiji Nat Kogyo KK) May 11, 1999.

Derwent Abstract Accession No. 80-C6243C/12, FR 2428372 A (Merlin & Gerin SA) Feb. 8, 1980.

Derwent Abstract Accession No. 83-G2401K/19, FR 2514103 A (Grun) Apr. 8, 1983.

Derwent Abstract Accession No. 97-345802/32, P52, JP 9 141333 A (Kokusai Denki KK) Jun. 3, 1997.

Derwent Abstract Accession No. 98-265616/24, P52, JP 10 085837 A (Mitsubishi Electric Corp) Apr. 7, 1998.

Patent Abstracts of Japan, vol. 004, No. 053 (M-008), Apr. 19, 1980 (JP 55-022468 A).

Patent Abstracts of Japan, vol. 015, No. 006 (M-1066), Jan. 8, 1991 (JP 02-258116).

EasyBend™—Complex Bending Made Easy, © 2004 Mate Precision Tooling Inc., Anoka, Minnesota.

Publication "Office dA" by Contemporary World Architects, Rockport Publishers, Inc., Gloucester, Massachusetts, 2000, pp. 15, 20-35.

Singh, H., "Sheet Metal Hydroforming", Fundamentals of Hydroforming, Society of Manufacturing Engineers, Dearborn, Michigan (2003), pp. 29-35.

Snap to it, International Sheet Metal Review, Sep./Oct. 2005, pp. 40-42.

SnapLock™—Fabricated Joints Without Welding, © 2002 Mate Precision Tooling Inc., Anoka, Minnesota.

U.S. Appl. No. 09/640,267, filed Aug. 17, 2000, Durney.

U.S. Appl. No. 10/256,870, filed Sep. 26, 2002, Durney.

U.S. Appl. No. 10/672,766, filed Sep. 26, 2003, Durney, et al.

U.S. Appl. No. 10/795,077, filed Mar. 3, 2004, Durney, et al.

U.S. Appl. No. 10/821,818, filed Apr. 8, 2004, Durney, et al.
U.S. Appl. No. 10/827,818, filed Apr. 8, 2004, Fiean Liem.
U.S. Appl. No. 10/861,726, filed Jun. 4, 2004, Durney, et al.
U.S. Appl. No. 10/931,615, filed Aug. 31, 2004, Durney, et al.
U.S. Appl. No. 10/938,170, filed Sep. 10, 2004, Durney.
U.S. Appl. No. 10/952,357, filed Sep. 27, 2004, Durney.
U.S. Appl. No. 10/985,373, filed Nov. 9, 2004, Durney, et al.
U.S. Appl. No. 11/016,408, filed Dec. 16, 2004, Durney, et al.
U.S. Appl. No. 11/080,288, filed Mar. 14, 2005, Durney, et al.
U.S. Appl. No. 11/180,398, filed Jul. 12, 2005, Durney, et al.
U.S. Appl. No. 11/290,968, filed Nov. 29, 2005, Durney, et al.
U.S. Appl. No. 11/357,934, filed Feb. 16, 2006, Durney.
U.S. Appl. No. 11/374,828, filed Mar. 13, 2006, Durney.
U.S. Appl. No. 11/384,216, filed Mar. 16, 2006, Durney.
U.S. Appl. No. 11/386,463, filed Mar. 21, 2006, Durney.
U.S. Appl. No. 11/411,440, filed Apr. 25, 2006, Durney, et al.
U.S. Appl. No. 11/533,355, filed Sep. 19, 2006, Durney.
U.S. Appl. No. 11/611,100, filed Dec. 14, 2006, Durney.
U.S. Appl. No. 11/746,375, filed May 9, 2007, Durney.
U.S. Appl. No. 11/754,344, filed May 28, 2007, Durney, et al.
U.S. Appl. No. 11/842,932, filed Aug. 21, 2007, Holman, et al.
U.S. Appl. No. 11/849,481, filed Sep. 4, 2007, Durney.
U.S. Appl. No. 11/925,195, filed Oct. 26, 2007, Durney, et al.
U.S. Appl. No. 11/927,341, filed Oct. 29, 2007, Durney, et al.
U.S. Appl. No. 11/927,608, filed Oct. 29, 2007, Durney.
U.S. Appl. No. 11/927,626, filed Oct. 29, 2007, Durney, et al.
U.S. Appl. No. 11/927,666, filed Oct. 29, 2007, Durney, et al.
U.S. Appl. No. 11/928,074, filed Oct. 30, 2007, Durney.
U.S. Appl. No. 11/928,433, filed Oct. 30, 2007, Durney, et al.
U.S. Appl. No. 11/928,504, filed Oct. 30, 2007, Durney, et al.
U.S. Appl. No. 11/928,596, filed Oct. 30, 2007, Durney.
U.S. Appl. No. 11/929,094, filed Oct. 30, 2007, Durney, et al.
U.S. Appl. No. 11/929,201, filed Oct. 30, 2007, Durney.
U.S. Appl. No. 11/929,747, filed Oct. 30, 2007, Durney.
U.S. Appl. No. 11/929,780, filed Oct. 30, 2007, Durney, et al.
U.S. Appl. No. 11/930,035, filed Oct. 30, 2007, Durney, et al.
U.S. Appl. No. 11/930,058, filed Oct. 30, 2007, Durney, et al.
U.S. Appl. No. 12/028,713, filed Feb. 8, 2008, Durney.
U.S. Appl. No. 12/103,547, filed Apr. 15, 2008, Durney.
U.S. Appl. No. 12/235,551, filed Sep. 22, 2008, Durney, et al.
U.S. Appl. No. 12/235,571, filed Sep. 22, 2008, Durney, et al.
U.S. Appl. No. 12/235,586, filed Sep. 22, 2008, Durney, et al.
U.S. Appl. No. 12/250,515, filed Oct. 13, 2008, Durney, et al.
U.S. Appl. No. 12/341,951, filed Dec. 22, 2008, Durney, et al.
U.S. Appl. No. 12/372,493, filed Feb. 17, 2009, Durney, et al.
U.S. Appl. No. 12/468,654, filed May 19, 2009, Durney.
U.S. Appl. No. 12/703,654, filed Feb. 10, 2010, Durney.
U.S. Appl. No. 60/799,215, filed May 9, 2006, Durney.
U.S. Appl. No. 60/799,217, filed May 9, 2006, Durney.

* cited by examiner

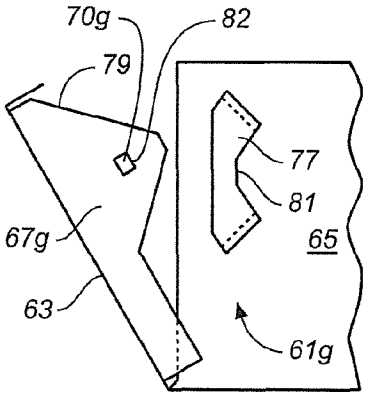
FIG. 12A
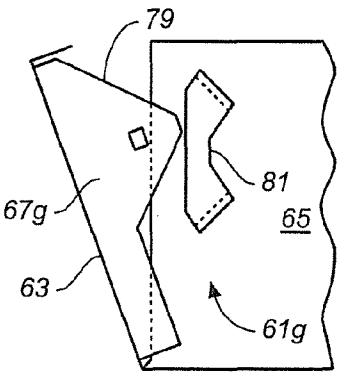
FIG. 12B
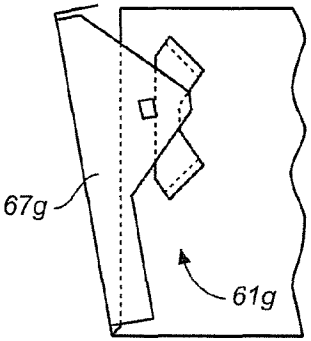
FIG. 12C
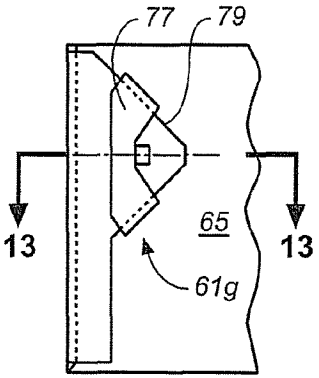
FIG. 12D
FIG. 13A
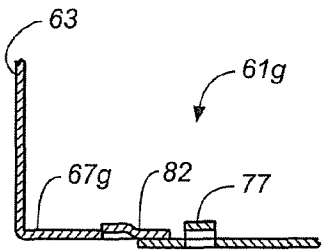
FIG. 13B
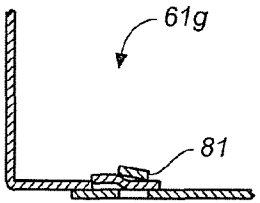
FIG. 13C
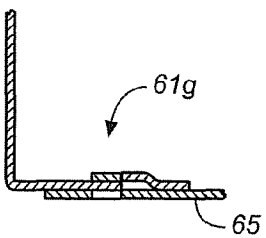
FIG. 13D

METHOD OF FORMING TWO-DIMENSIONAL SHEET MATERIAL INTO THREE-DIMENSIONAL STRUCTURE

CROSS-REFERENCES TO RELATED APPLICATIONS

This application is a Divisional of U.S. patent application Ser. No. 11/925,195, filed Oct. 26, 2007, and entitled METHOD OF FORMING TWO-DIMENSIONAL SHEET MATERIAL INTO THREE-DIMENSIONAL STRUCTURE, which claims priority to U.S. Provisional Patent Application No. 60/854,846, filed Oct. 26, 2006, and entitled SHEET MATERIAL WITH BEND CONTROLLING DISPLACEMENTS, and to U.S. Provisional Patent Application No. 60/974,473, filed Sep. 23, 2007, and entitled METHOD OF FORMING TWO-DIMENSIONAL SHEET MATERIAL INTO THREE-DIMENSIONAL STRUCTURE, the entire contents of which applications is incorporated herein by this reference.

BACKGROUND OF THE INVENTION

1. Field of the Invention

This invention relates, in general, to preparing sheets of material for bending using punching, stamping, roll-forming, and similar processes and then bending the sheets into three-dimensional structures.

2. Description of Related Art

Various methods of preparing sheet materials for precision folding along a desired bend line have been developed. For example, U.S. Pat. Nos. 6,877,349, 6,877,349, 7,032,426, 7,152,449 and 7,152,450 describe various methods of preparing and folding sheet materials for forming three-dimensional objects having relatively high tolerances from substantially planar two-dimensional sheets.

The folding-structures shown and described above promote so-called edge-to-face engagement and other phenomena to facilitate folding along a desired bending line. For example, as discussed in the above-mentioned '450 patent, displacements may be formed to facilitate bending along a desired bend line. In some instances, gaps may be formed between a sheared edge of a displacement and an opposing face of the bent sheet material. For example, the gaps may be designed into the bend-controlling structures to further facilitate bending. As another example, the gaps may result from an engineered design to provide clearance during bending or lower manufacturing tolerances. In yet another example, the gaps may be undesired, and may have resulted from various factors.

The presence of such gaps along the folded edges may present problems. As noted in the above-mentioned '449 patent, certain flat sheets that are slit or grooved can have electrical components mounted to them using "pick-and-place" techniques. The sheets may then be folded into enclosures or housings in which all of the components are spatially related in the desired positions inside the housing. While there is considerable advantage to slit-forming or groove-forming techniques, in applications where shielding is important, gaps along the enclosure edges may lead to electromagnetic ("EM") waves or radio-frequency ("RF") signal noise leakage out of the structure.

Additionally, the presence of gaps or pockets along the bend lines may, in some instances, reduce the strength of the folded structure. For example, because the gaps decrease the surface contact between edge and face, the folded structure may have less surface area to support loading. In such cases, it may be desirable to increase the structural integrity of the folded product in the gap regions.

In addition, traditional manufacturing techniques often require the use of various fasteners to hold panels of a sheet material in a folded 3D structure.

It would therefore be useful to provide a sheet of material having bend-controlling structures that facilitate precise bending techniques, reduce the gap area near the bend lines, and/or include securing structures that may reduce the need for fasteners in securing a 2D sheet material into a 3D structure.

DISCLOSURE OF THE INVENTION

One aspect of the present invention is directed to a method of preparing a substantially two-dimensional sheet material for bending along a bend line to form a three-dimensional object. The method includes one or more of the steps: obtaining a sheet material that is substantially two-dimensional in a region in which a bend is to be made; and forming a plurality of displacements in a thickness direction of the sheet material with a portion of a periphery of the displacement closest to the bend line shearing to provide the periphery with an edge and an opposed face, the edge and opposed face configured to produce edge-to-face engagement of the sheet material during bending; wherein the plurality of displacements are located on one side of the bend line.

The forming step may be accomplished by forming at least some of the displacements with large-radii ends, wherein a portion of the periphery of the displacements may diverge from the bend line. The forming step may be accomplished by forming a half strap along adjacent diverging portions of the peripheries of adjacent displacements, which half straps are configured to undergo tension and torsion during bending. The forming step may be accomplished by forming an intermediate strap portion between adjacent half straps, which half straps are configured to undergo greater three-dimensional deformation bending during bending. The forming step may be accomplished by forming the periphery of at least some of the displacements with a non-linear portion intermediate the large-radii ends.

The forming step may include forming at least one protrusion adjacent to the bend line and extending in the same direction as a respective displacement, wherein when one panel portion of the sheet material on one side of the bend line may be folded relative to another panel portion on the other side of the bend line, and the protrusion extend to conductively interconnect said one and another panel portions across the bend line. The protrusion may extend from at least one displacement and may be configured to contact the panel portion of the sheet material on the other side of the bend line, the method may further include the step of bending the sheet material to effect contact of the protrusion and the panel portion on the other side of the bend line. The protrusion may extend from one panel portion of the sheet material and may be configured to contact at least one displacement on the other side of the bend line. The method may further include the step of bending the sheet material to effect contact of the protrusion and the displacement on the other side of the bend line.

The forming step may include forming a securing structure in the sheet material configured to secure one panel portion of the sheet material to another panel portion of the sheet in a folded position. The method may further include the steps of bending one panel portion of the sheet material about a corresponding bend line and securing said one panel portion to another panel portion of the sheet material with a securing structure monolithically formed in the sheet material.

Another aspect of the present invention is directed to a method of preparing a substantially two-dimensional sheet material for bending along a bend line to form a three-dimensional object. The method include one or more of the steps of obtaining a sheet material that may be substantially two-dimensional in a region in which a bend may be to be made; forming a plurality of displacements in a thickness direction of the sheet material with a portion of the periphery of the displacement closest to the bend line shearing to provide the periphery with an edge and an opposed face, the edge and face configured to produce edge-to-face engagement of the sheet material during bending; and forming at least one protrusion adjacent to the bend line extending in the same direction as a respective displacement.

The protrusion may extend from at least one displacement and may be configured to contact the panel portion of the sheet material on the other side of the bend line. The method may further include the step of bending the sheet material to effect contact of the protrusion and the panel portion on the other side of the bend line. The protrusion may extend from one panel portion of the sheet material and may be configured to contact at least one displacement on the other side of the bend line. The method may further include the step of bending the sheet material to effect contact of the protrusion and the displacement on the other side of the bend line. The protrusion may extend from one panel portion of the sheet material and may be configured to contact at least one displacement on the other side of the bend line. The method may further include the step of bending the sheet material to effect contact of the protrusion and the displacement on the other side of the bend line. The protrusion may be monolithically formed from the sheet material. The protrusion and a corresponding displacement are simultaneously formed. A plurality of protrusions may be configured to extend from, or contact, at least one of said displacements. The protrusion may extend out-of-plane with respect to a displacement.

In some embodiments, the plurality of displacements are located on one side of the bend line. The method may further include the steps of bending one panel portion of the sheet material about a corresponding bend line and securing said one panel portion to another panel portion of the sheet material with a securing structure monolithically formed in the sheet material.

Still another aspect of the present invention is directed to a method of preparing a substantially two-dimensional sheet material for bending along a plurality of bend lines to form a three-dimensional object including one or more of the steps: forming a plurality of bend-facilitating structures in the sheet material along a plurality of bend lines to form at least a first panel portion and a second panel portion; forming a fastening flange in the first panel portion substantially parallel to the second panel portion; and forming a fastening receiver in the second panel portion configured to receive a portion of the fastening flange in the first panel portion; forming a securing button in one of the first and second panel portion and a corresponding securing recess in the other of the first and second panel portions. The fastening flange, the fastening receiver, the securing button, and the securing recess may be monolithically formed in the sheet material.

The fastening receiver may be formed with a displaced flap extending from the second panel portion. The fastening receiver may be configured to receive the fastening flange between the displaced flap and a surface of the second panel portion. The fastening flap may be formed with a stop edge configured to limit folding movement of the first panel portion relative to the second panel portion and to align the latch button with the latch recess. The stop edge may be substantially C-shaped. The fastening flap may be formed with a bridge portion under which the fastening flap may extend, and wherein the fastening flap may be formed with a latch surface which forms the latch recess. The bridge portion may include at least one stop edge configured to limit folding movement of the first panel portion relative to the second panel portion and to align the latch button with the latch surface. The bridge portion may include two diverging stop edges.

Yet another aspect of the present invention is directed to a method of preparing a sheet of material for bending along a bend line comprising the step of forming a plurality of displacements in the thickness direction of the sheet of material with a portion of the periphery of the displacement closest to the bend line providing an edge and an opposed face configured and positioned to produce edge-to-face engagement of the sheet of material during bending, wherein the plurality of displacements are located on one side of the bend line. The forming step may be accomplished by forming the plurality of displacements with large-radii ends, and a portion of the periphery of the displacements remote from the bend line may include a non-linear portion intermediate the large-radii ends.

Still a further aspect of the present invention is directed to a sheet of material suitable for bending along a bend line including a sheet of material having a plurality of displacements in a thickness direction of the sheet of material, a portion of the periphery of the displacement closest to the bend line providing an edge and an opposed face configured and positioned to produce edge-to-face engagement of the sheet of material on opposite sides of the portion of the periphery during bending, wherein the plurality of displacements are located on one side of the bend line. The plurality of displacements may have large-radii ends, and wherein a portion of the periphery of the displacements remote from the bend line includes a non-linear portion intermediate the large-radii ends.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

BRIEF DESCRIPTION OF THE DRAWINGS

FIG. 12A, FIG. 12B, FIG. 12C and FIG. 12D are elevational views of another a three-dimensional object similar to that of FIG. 2 but including another exemplary securing structure, the object respectively shown in a series of partially and fully folded.

FIG. 13A, FIG. 13B, FIG. 13C and FIG. 13D is a sequence of cross-sectional views of the object of FIG. 12 taken substantially along the line 13-13 in FIG. 12D.

FIG. 14A is a schematic plan view of a displacement utilized in the two-dimensional sheet material of FIG. 1, while FIGS. 14A-14J are schematic plan view of alternative displacements for use with the sheet material, and FIGS. 14K-14L, are schematic cross-sectional views of the displacements of FIGS. 14B-14F and FIGS. 14G-14J, respectively.

DETAILED DESCRIPTION OF THE INVENTION

Reference will now be made in detail to various exemplary embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other exemplary embodiments, which may be included within the spirit and scope of the invention as defined by the appended claims.

Figure 1:
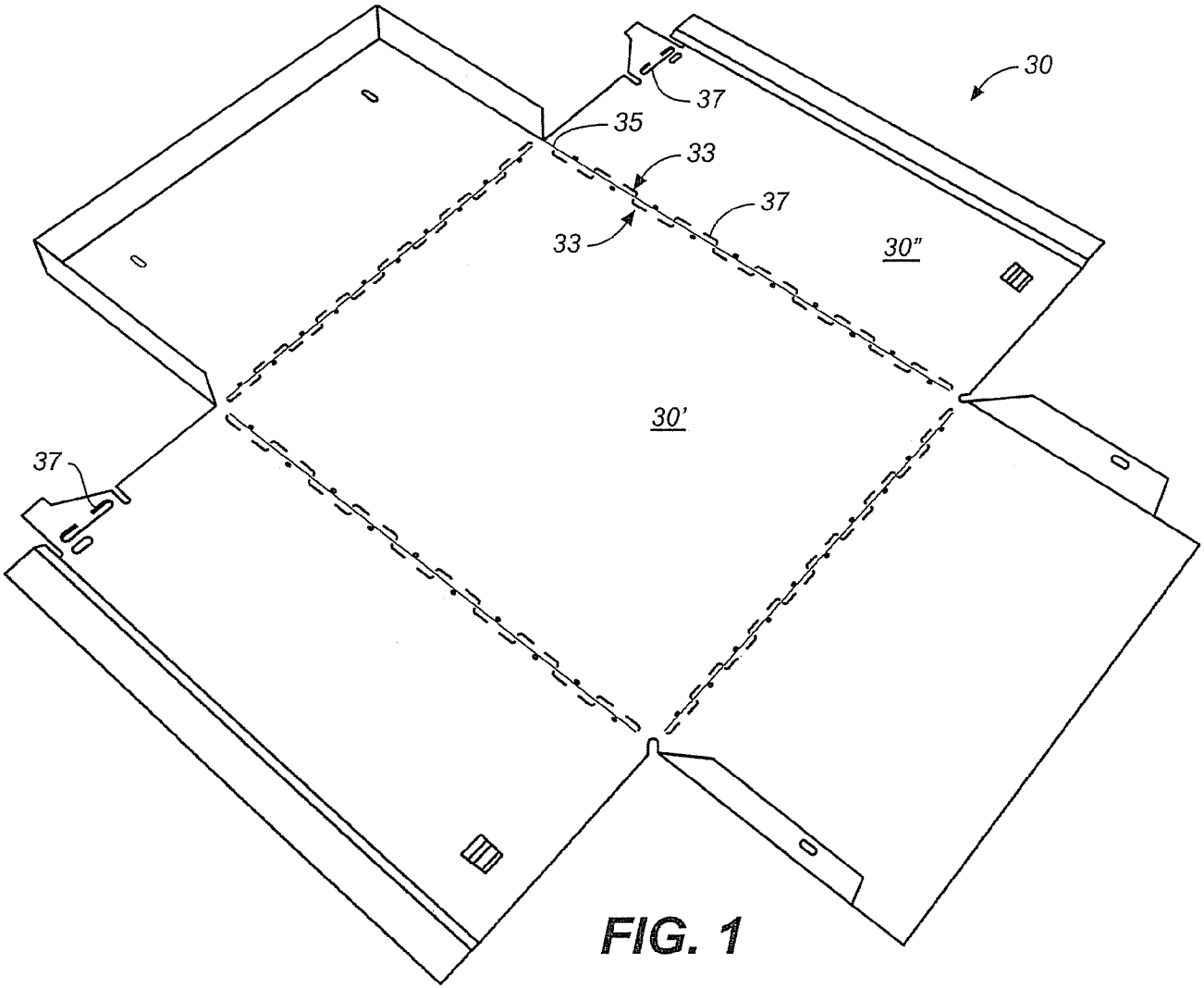
FIG. 1 is a perspective view of a substantially two-dimensional sheet material having a plurality of folding displacements along a bend line.
Figure 2:
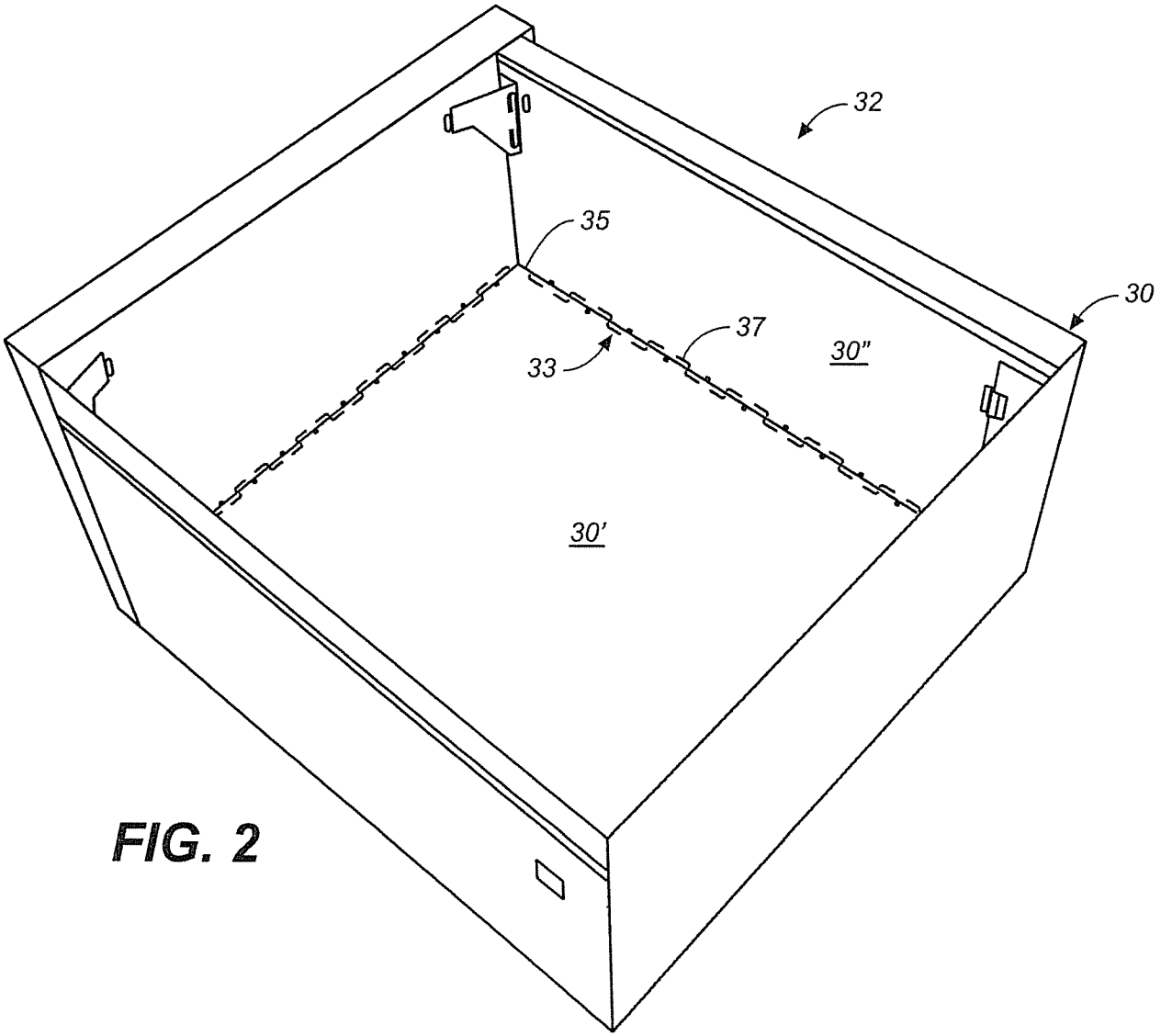
FIG. 2 is a perspective view of the two-dimensional sheet material of FIG. 1 folded into a three-dimensional object.

Turning now to the drawings, wherein like components are designated by like reference numerals throughout the various figures, attention is directed to FIG. 1 and FIG. 2 which disclose an exemplary two-dimensional (2D) sheet material 30 that has been dimensioned and configured to form a three-dimensional (3D) open box 32. In many aspects, the exemplary sheet material of the present invention is similar to that which is described in U.S. Provisional Patent Application No. 60/665,577 filed Mar. 25, 2005 and U.S. patent application Ser. No. 11/386,463 (Pub. No. 2006/0277965), the entire contents of both applications is incorporated in their entirety by this reference.

As described in the below-mentioned patents and patent applications, there are numerous applications in which 2D sheet materials can be formed into 3D articles. The depiction of an open box is merely exemplary; the teachings of the present inventions for precision bending are also applicable to the production of numerous other 3D articles including, but not limited to, electronic component chasses, automotive components, transport components, construction components, appliances parts, truck components, RF shields, HVAC components, aerospace components, and more. That is, the teachings of the present application are applicable to a wide variety of 3D products and articles that are formed by folding 2D sheet materials.

In many aspects, the sheet materials fold lines and folding straps of the present invention are similar to those disclosed by U.S. Pat. No. 6,481,259, U.S. Pat. No. 6,877,349, U.S. Pat. No. 7,152,449, U.S. Pat. No. 7,152,450, U.S. patent application Ser. No. 10/821,818 (Pub. No. 2005/0005670), U.S. Pat. No. 7,032,426, U.S. patent application Ser. No. 10/931,615 (Pub. No. 2005/0097937), U.S. patent application Ser. No. 10/985,373 (Pub. No. 2005/0061049), U.S. patent application Ser. No. 11/357,934 (Pub. No. 2006/0261139), U.S. patent application Ser. No. 10/952,357 (Pub. No. 2005/0064138, U.S. Patent Application No. 11/384,216 (Pub. No. 2006/0207212), U.S. patent application Ser. No. 11/080,288 (Pub. No. 2005/0257589), U.S. patent application Ser. No. 11/374,828 (Pub. No. 2006/0213245), U.S. patent application Ser. No. 11/180,398 (Pub. No. 2006/0021413), U.S. patent application Ser. No. 11/290,968 (Pub. No. 2006/0075798), U.S. patent application Ser. No. 11/411,440, U.S. Provisional Patent Application No. 60/665,577, U.S. patent application Ser. No. 11/386,463, and U.S. Provisional Patent Application No. 60/854,846, the entire contents of which patents and patent applications are incorporated herein by this reference.

Briefly, the folding of the sheet of materials of the present invention is largely similar to the methods discussed extensively in the above-mentioned patent applications and patents, and in particular, the '870 and '726 applications. The main difference is, upon completion of folding, the protrusions of the present invention ensure that there is contact between both halves of the sheet material across the shear face of a corresponding displacement, which contact may promote electromagnetic interference ("EMI") and/or radio-frequency interference ("RFI") shielding and/or enhanced structural integrity.

Figure 3:
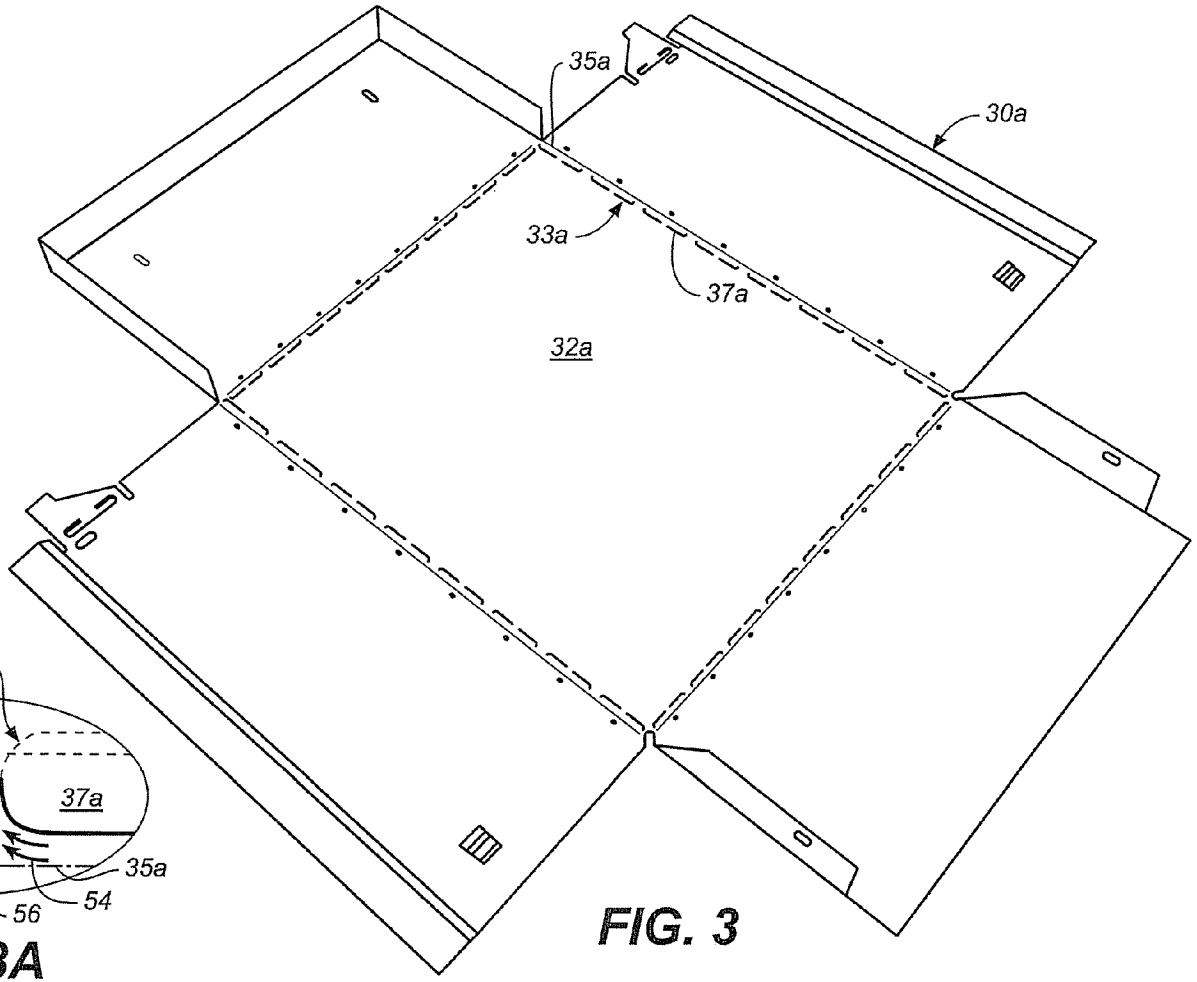
FIG. 3 is a perspective view of another two-dimensional sheet material having a plurality of folding displacements along a bend line.

Sheet material 30 includes a plurality of folding structures 33 formed in the sheet of material that are positioned along a desired fold line 35 in a manner similar to that described in the above-mentioned patents and patent applications. In the illustrated embodiment, the folding structures are displacements 37 In some embodiments, the folding structures or displacements 37 extend along opposite sides of the bend line 35, as shown in FIG. 1, while in other embodiments, the folding structures or displacements 37*a* may extend along one side of the bend line 35*a*, as shown in FIG. 3. In either case, the folding structures generally define a folding strap 39 which extends across the bend line interconnecting panel portions of the sheet material on either side of the bend line, that is, interconnecting substantially 2D or substantially flat portions on either side of the bend line (e.g., panel portions 30' and 30"). In some embodiments, the folding strap extends obliquely across its respective fold line (see, e.g., folding strap 39, FIG. 4), however, the strap need not extend in its entirety across the fold line. The portion of the folding strap which extends obliquely across the bend line serves to promote bend-assisting tension and torsion, in addition to just pure bending, across the bend line as discussed below.

Figure 4:
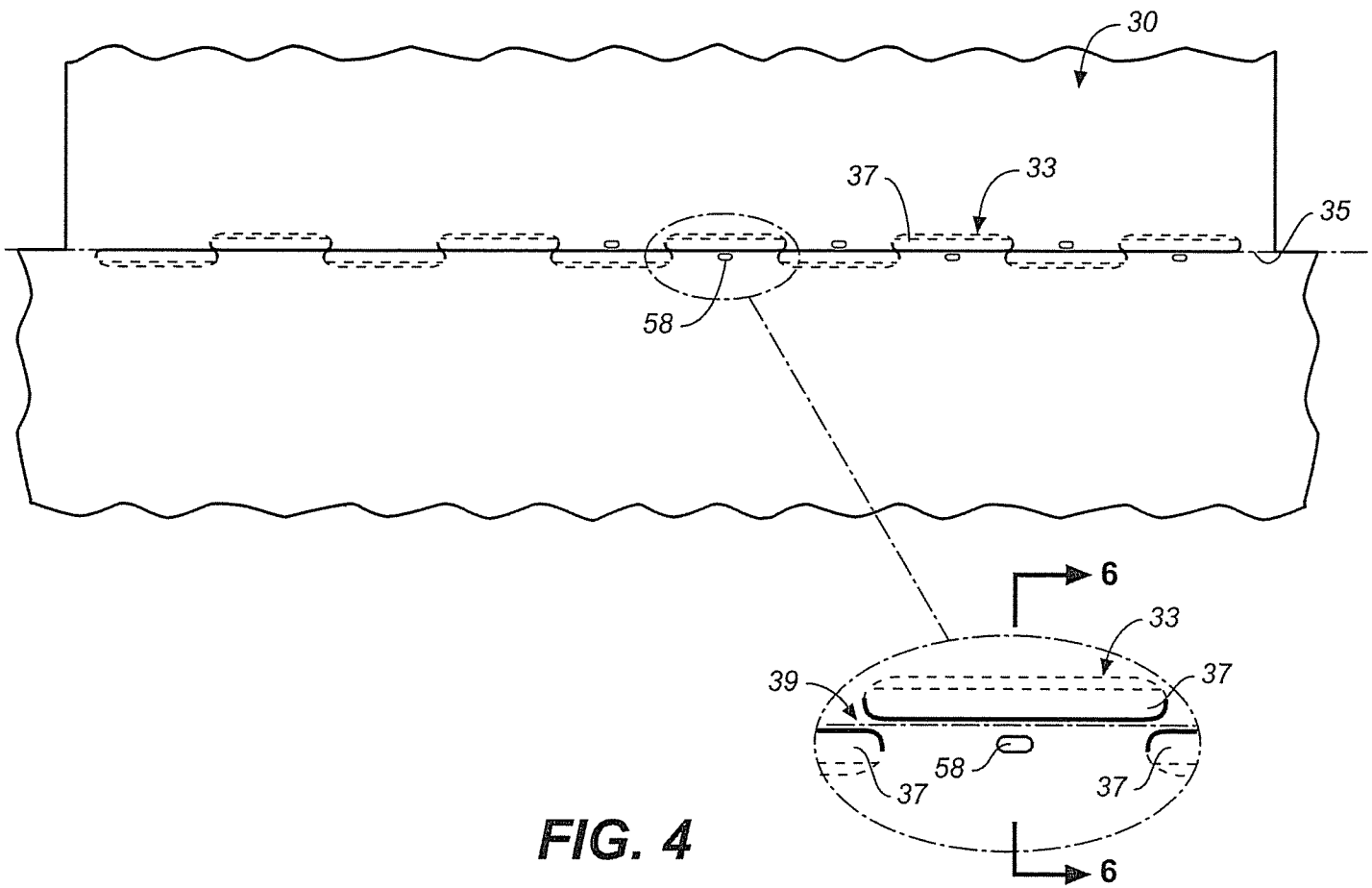
FIG. 4 is a plan view of an exemplary bend line of the sheet material of FIG. 1, the bend line having a plurality of displacements on opposite sides thereof.

Turning to FIG. 4, displacements 37 are formed in sheet of material 30 and are positioned along a fold line 35 in a manner similar to that described in the above-mentioned patents and patent applications. The displacements may be formed by stamping, punching, roll forming and/or other suitable means as is discussed in the '828 application and the other above-mentioned patents and patent applications. The folding structures are formed to allow precise folding of the sheet of material along the fold lines to ultimately position the sides in closely abutting relationship and form a 3D structure. One will appreciate that the number, position, and relative orientation of the bend lines will vary depending upon the desired shape of the 3D structure.

Figure 6:
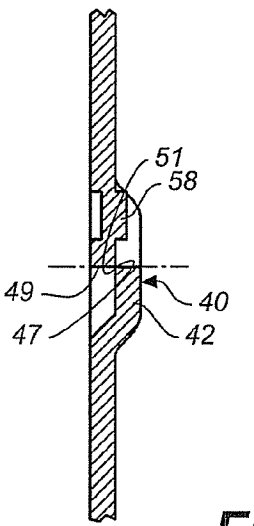
FIG. 6 is a cross-sectional view of the sheet material of FIG. 1 taken along line 6-6 of FIG. 4 and FIG. 5.
Figure 5:
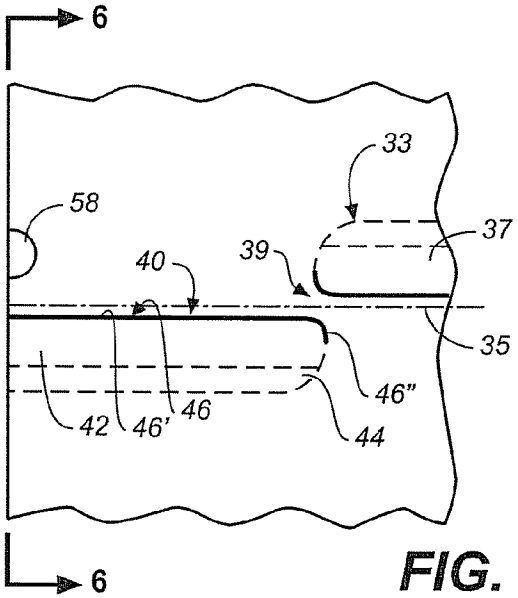
FIG. 5 is an enlarged view of a portion of the detail of FIG. 4.

The displacements, in many respects, are similar to those described in the above-mentioned '828 application. For example, each displacement 37 includes a tongue 40 which is displaced from the overall planar surface of sheet material 30. An exemplary embodiment of the tongue is shown in FIG. 5 and FIG. 6. The exemplary tongue has a flat zone 42 extending substantially parallel to the planar portion of the sheet material, and an inclined transition zone 44 extending from the overall planar portion of the sheet material to the flat zone. Preferably the tongue has a flat zone which may lead to increased tool life and other advantages, however, one will appreciate that the tongue need not have a flat zone.

Opposite transition zone 44 is a sheared face 46 that has sheared edges 47 extending there along (i.e., the corners formed by the intersection of sheared face 46 and the planar surfaces of displacement 37). In the illustrated embodiment the sheared edge only extends along one side of the displacement, but as described extensively in the above-mentioned patents and patent application, the actual degree of shearing may vary, if shearing exists at all.

In the illustrated embodiment, the displacements form a substantially D-shaped slit in that they have a relatively straight central portion 46' and curved end portions 46" that diverge away from the bend line. Also, the displacements may be configured to produce edge-to-face engagement (as described below) in a manner similar to that described in the above-mentioned patents and patent applications. For example, the sheet material may be configured such that one sheared edge 47 engages against an opposing face 49 during folding (not shown). Alternatively, the sheet material may be configured such that an opposing edge 51 engages against sheared face 46 during folding (see, e.g., FIG. 7). One will appreciate that the displacements may have other configurations which may or may not produce edge-to-face engagement.

Figure 3A:
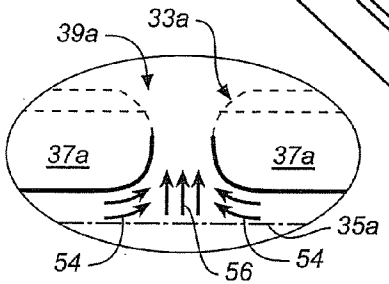
FIG. 3A is an enlarged plan view of the sheet material shown in FIG. 3.

Preferably, the curved ends of displacement 37 are relatively large-radii ends 53, which radii are greater than the thickness of the sheet material, preferably two or three times greater than the thickness of the sheet material, and more preferably more than three times the thickness, and even several times as thick. Such a configuration facilitates "strap" behavior that subjects portions of sheet material immediately adjacent the large-radii ends, which portions are generally referred to as a half-straps 54, to tension and torsion (see, e.g., FIG. 3A). These portions immediately adjacent the ends generally experience greater stress and deformation during bending. Using the half straps serve to realign such stresses and deformations to reduce, minimize, and/or prevent propagation of shear through strap 39 during bending, as well as during subsequent vibrations and cyclical or simple loading. The half straps may also serve to facilitate precision bending along the bend line.

Portions of the sheet material intermediate the half-straps generally undergo greater pure bending with relatively less torsion, as compared to the portions immediately adjacent the ends of the displacement. In particular, extending between adjacent half-straps 54 are intermediate strap portions or mid zones 56 that are relatively removed from large-radii ends but lying between two adjacent large-radii ends. These intermediate portions are generally subjected to more pure bending, that is, bending of the structure which results in compression along internal surfaces along the bend line and tension along external surfaces along the bend line with minimal torsion. In contrast, the half straps are generally subjected to relatively high tension and torsion but subjected to relatively less pure bending, or possibly minimal pure bending or no pure bending. As such, one will appreciate that the lengths of the intermediate portions may be vary as the half straps may primarily be responsible for facilitating precision bending along the bend line. Advantageously, longer intermediate portions may result in a reduced number of displacements required along a bend line, increased areas of material interconnecting portions of sheet material on either side of the bend line, and/or other advantages.

Figure 8:
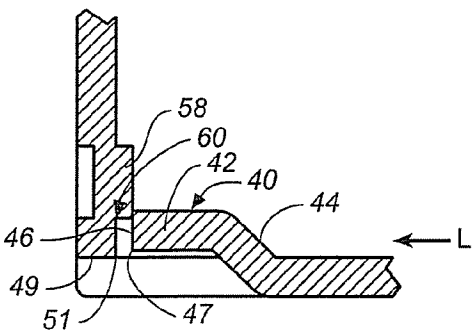
FIG. 8 is a cross-sectional view of the sheet material of FIG. 1 shown in another folded position similar to that shown in FIG. 7.
Figure 7:
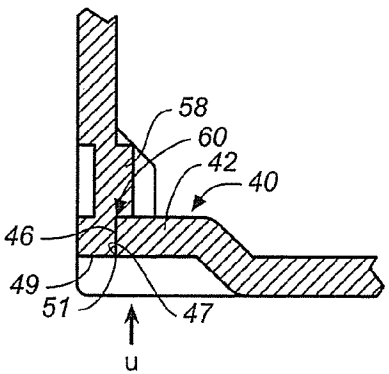
FIG. 7 is a cross-sectional view of the sheet material of FIG. 1 shown in a folded position.

Turning now to FIG. 7 and FIG. 8, in some instances, a gap may form between sheared face 46 and the opposing edge 51 when a 2D sheet material 30 is folded into a 3D box 32 or other object. While in some cases, such gaps may be desired and designed into the fold line, in other cases, the gaps may be unintentional and/or undesired.

In some instances, radio-frequency ("RF") leakage may be a concern. For example, when the bending technology described in the above-mentioned patents and patent applications is used to form RF shields, such gaps may create a corner joint or intersection in which gaps of unconnected material, that is, gaps between panel portions of the sheet material on either side of the bend line are of sufficient length that the gaps allow for undesirable RF leakage. In other instances, the 3D object may be a load bearing object, in which case, gaps of significant length may be sufficiently long to decrease the structural integrity of the 3D object.

Referring again to FIG. 4 et seq., sheet of material 30 may be provided with nipples 58 or other types of protrusions in order to diminish the undesirable effects of such gaps 60. Preferably the protrusions are monolithically formed with the sheet material, and more preferably, stamped, punched, roll-formed or otherwise formed simultaneously with the corresponding displacement. The protrusions may be formed in the same step or sequentially with the displacement. One will appreciate, however, that the protrusions may be discrete and attached to the sheet material (or displacement) by suitable means. In the instances where RF leakage is a concern, it is preferred that the protrusions are electrically conductive with the sheet material. One will further appreciate that when gaps and/or RF leakage is not a concern, the sheet material may be formed without the protrusions (see, e.g., FIG. 4).

The protrusions are dimensioned and configured to reduce effective length of edge-to-face gaps 60 by extending across the gap and abutting against a portion of sheet material 30 on the other side of the bend line. For example, FIG. 7 illustrates protrusion 58 engaging against the upper planar surface of tongue 40, while FIG. 8 illustrates a protrusion 58 that abuts engages against sheared face 46. The protrusions project from the sheet on an opposite side of the bend line as a respective displacement and, as the protrusion is located approximately even with the mid point of the corresponding sheared face, effectively cuts the effective length of the gap by one-half. In this manner, gap 60 may be at least partially "closed" to reduce or prevent RF leakages. Also, the abutting configuration of protrusion-against-tongue may provide structural support. For example, protrusion 58 in FIG. 7 would limit upward movement of tongue 40 relative to the protrusion 58 (see, e.g., arrow "U"), while the protrusion in FIG. 8 would limit leftward movement of the tongue relative to the protrusion (see, e.g., arrow "L"). As such, protrusion 58 may support displacement 37 in a direction in which the displacement would otherwise be free to move. To further enhance structural support, multiple protrusions may be provided between strap, as discussed below.

Figure 9:
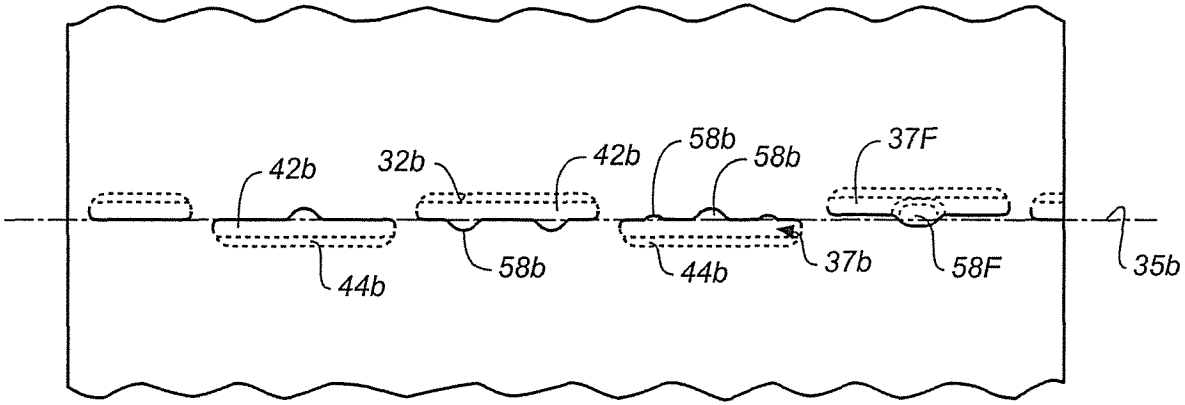
FIG. 9 is an elevational view of another exemplary bend line that may be used with the sheet material of FIG. 1, the bend line having a plurality of displacements on opposite sides thereof.

In another embodiment, the protrusion may be provided on the tongue such that the protrusion extends across the bend line and thus ensures contact across the bend line. For example, FIG. 9 illustrates a number of protrusions 58*b* located on displacements 37*b*. As can be seen in the figure, one, two, three or more protrusions may be provided on the displacements. Also, protrusions may be provided on adjacent displacements, or not. In the embodiments of FIG. 9, each displacement 37*b* is formed in a downward direction with a downwardly sloping inclined transition region 44*b*, and each protrusion 58*b* extends downwardly from flat portion 42*b*. In one embodiment, each protrusion is positioned at an end of a tongue along a sheared edge.

Figure 10:
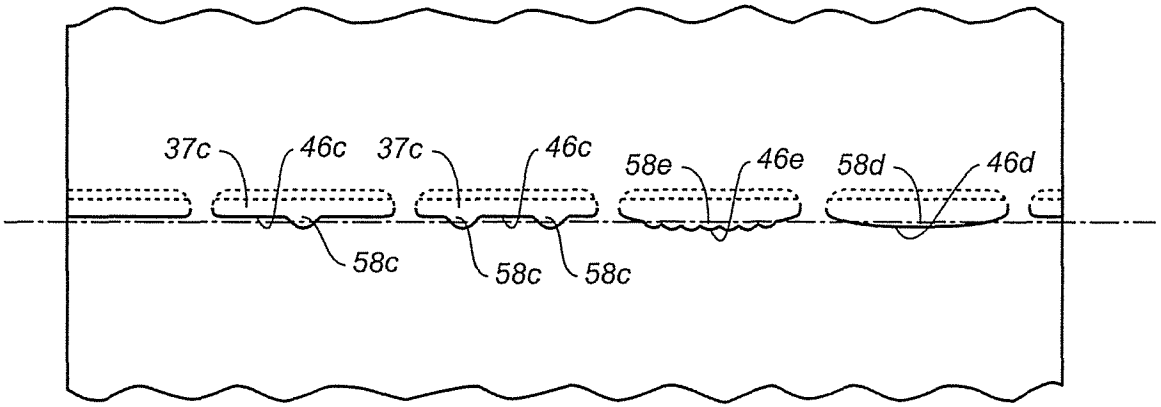
FIG. 10 is an elevational view of another exemplary bend line that may be used with the sheet material of FIG. 1, the bend line having a plurality of displacements on one side thereof.

As shown in FIG. 10, protrusions 58*c* may extend from a substantially straight sheared face 46*c*, however, the protrusions may have other configurations and still be effective to reduce the effective length of the gap. For example, the protrusion may be in the form of a outwardly-bowed sheared face 46*d*, or may be in the form of an scalloped face 46*e*. Also, the protrusions appear to be as effective in "closing" the gap for displacements arranged along one side of the bend line, as shown in FIG. 10, as they are for displacement arranged along both sides of the bend line, as shown in FIG. 9.

Referring now to FIG. 9, one will appreciate that protrusions extending from a displacement may extend out-of-plane from the displacement. For example, protrusions 58*f* may extend above or below the corresponding displacement 37*f*.

One skilled in the art will understand that the protrusions may have a variety of shapes, sizes, configurations, and positions in the folding structure as necessitated by the application. Such application factors include, but are not limited to, the folding characteristics and manufacturing and design specifications for the three-dimensional structure to be formed. As shown in FIG. 9 and FIG. 10, the shapes and sizes of the protrusions may also vary from displacement to displacement along a bend line. Also, various manufacturing specifications may also dictate the desired size, shape, and configuration of the protrusions.

Figure 11B:
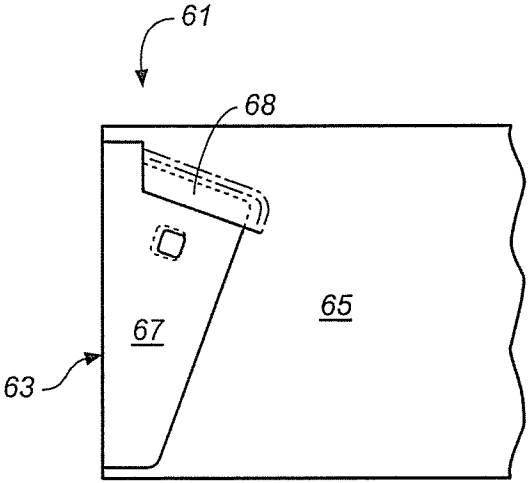
FIG. 11A and FIG. 11B are elevational views of a three-dimensional object similar to that of FIG. 2, including another exemplary securing structure; the object respectively shown partially and fully folded.
Figure 11A:
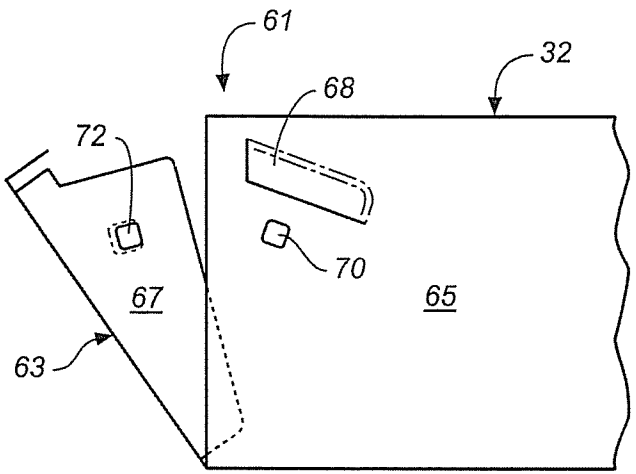
Figure 14:
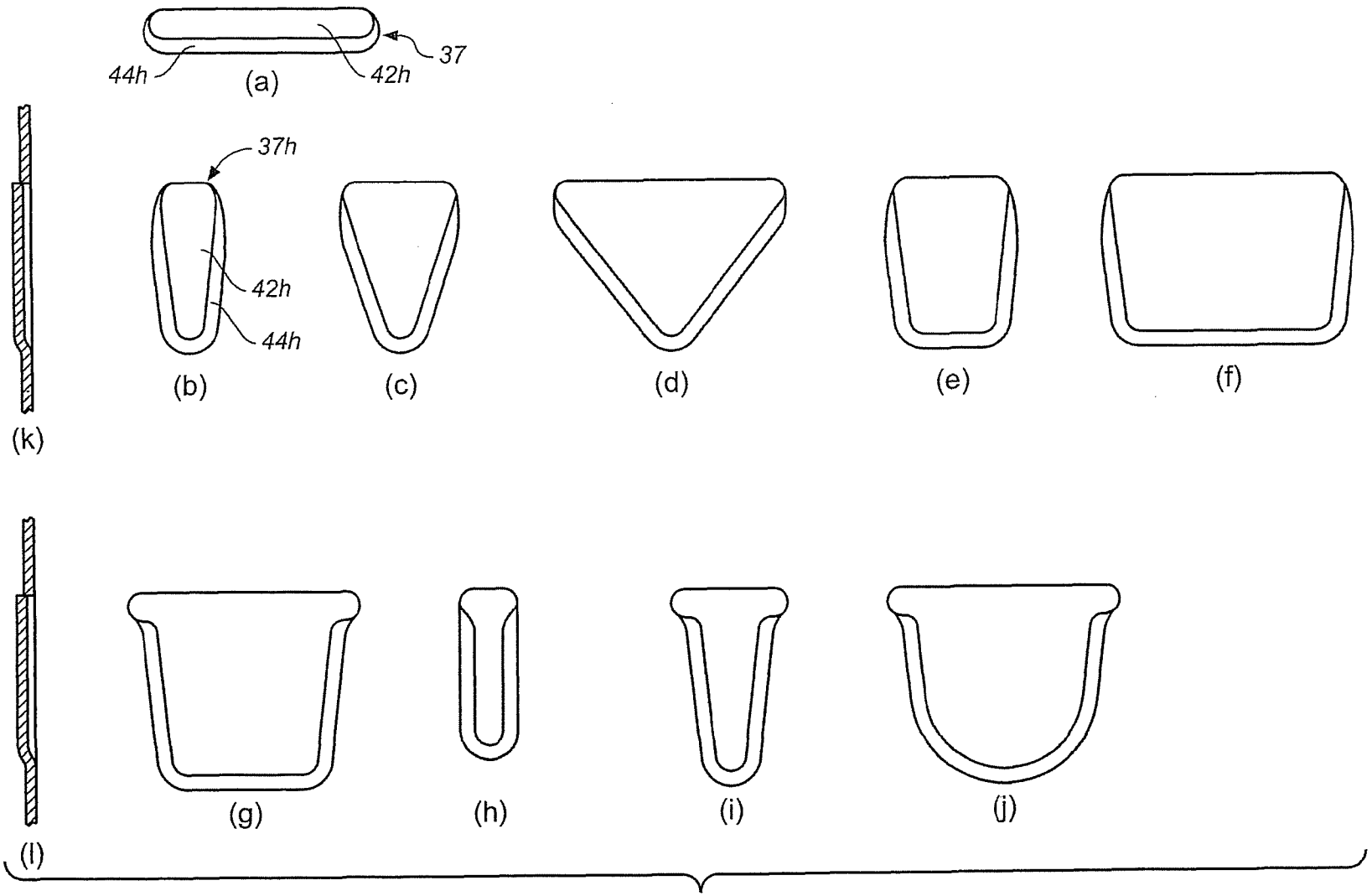

Turning now to FIG. 11A and FIG. 11B, various methods of securing the 2D sheet material into a 3D shape may be utilized in accordance with the present invention. Securing structures and other latches may be provided to fasten one panel portion of the sheet material to another panel portion of the sheet material to form the 3D structure. In an exemplary embodiment, securing structure 61 guides and secures a folding or swinging side 63 to one or more stationary sides 65. The folding side is provided with a fastening flange 67 while the stationary side is provided with a cooperating fastening flap 68 that receives and guides a portion of the fastening flange such that latch button 70 will engage with latch opening 72. In the exemplary embodiment, the opening is actually an outward displacement which creates a recess that receives the latch button to latch swinging side 63 in place relative to stationary side 65. In such cases, it is preferred that the sheared edges of the button (e.g., 70') and the opening (e.g., 72') are directed away from the swinging side to ensure positive latching. In particular, the fastening flap is dimensioned and configured to receive a running edge 74 of fastening flange 67 and hold the fastening flange in a position closely abutting against the surface of stationary side 65. In the exemplary embodiment, the fastening flap is provided with an optional stop edge which is configured to limit movement of the folding side inward, as is a stop edge on the fastening flange, and thus facilitates engagement of the latch button and latch opening.

As can be seen from the figures, the components of securing structure 61 may be formed by stamping, punching, roll-forming, and/or other suitable means. Accordingly, the securing structure may be formed simultaneously, or sequentially, with the bend-facilitating displacements discussed above. One will further appreciate that the illustrated securing structure may be monolithically formed from the sheet material. As such, one will also appreciate that the securing structure may be used to secure folded panel portions of the sheet material together without the need for additional or discrete fasteners. Accordingly, the securing structures of the present invention not only reduce part count and its associated costs, but may also facilitate quality and accuracy reducing product cost while also facilitating assembly and thus reduce labor and its associated time and costs.

In still another exemplary embodiment of the present invention shown in FIG. 12 and FIG. 13, securing structure 61*g* is similar to that described above but includes a bridge 77 through which a leading edge 79 of fastening flange 67*g* extends. In the illustrated embodiment, latch button 70*g* is provided on fastening flange 67*g* and, instead of a latch opening, the bridge is provided with a latch surface 81. One will appreciate that the bridge may also be used with the latch button and latch opening of the above-described embodiment.

In a manner similar to that described above, bridge flap 77 guides the fastening flange 67*g* of swinging side 63*g* into position such that leading edge 79 of fastening flange extends under the bridge flap and is sandwiched between the bridge flap and the planar surface of stationary side 65. Like the displacements described above, latch button may be formed by stamping, punching, roll-forming and/or other suitable means. As such, the latch button has ramped edge 82 that facilitates insertion of the leading edge 79 and latch button 70 under the bridge. In particular, the ramped edge will bias bridge portion 77 outwardly (see, e.g., FIG. 12C and FIG. 13C) until the latch button passes beyond latch surface 81. Once in the folded position, bridge 77 is configured to snap back to its original position such that latch the button opening engages against the latch surface to prevent the folding side from folding away from the stationary side, as shown in FIG. 12C and FIG. 13C. Preferably, the latch surface and latch button have corresponding shapes such that the clasp is secured in the opening, with reduced movement.

One will appreciate that the securing structures may have other suitable configurations. For example, the latch button 70 could configured and dimensioned such that it descends into the void left by displacement under bridge portion 77.

The free edge of the latch button abuts a front edge of the bridge portion to positively secure the fold into place in the lateral direction. In order to open the structure, a user lifts the bride and pushes on the latch button to pass it back under the bridge portion. In keeping with the spirit of the invention, one skilled in the art will understand that the securing mechanism and structures may have a variety of shapes, sizes, configurations, and positions in the sheet of material as necessitated by the application. The securing structures act to position and optionally secure a folded side of a sheet of material of the present invention into position. In this manner, the securing structures act not only to facilitate folding but also to added structure integrity to the folded structure.

In other exemplary embodiments of the present invention, alternatively shaped displacements may be utilized, such as those shown in FIGS. 14A-J. For example, displacement 37*h* is similar to displacement 37 described above in that flat zone 42*h* still has a linear portion extending along the bend line, however, the portion of the flat zone remote from the bend line has a non-linear geometry, and a similarly shaped transition zone 44*h*. In operation and use, displacement 37*h* is used in substantially the same manner as displacement 37 as the linear portion still engages the sheet material on the other side of the bend line in a manner similar to that discussed in the above-mentioned '828 application.

For convenience in explanation and accurate definition in the appended claims, the terms "up" or "upper", "down" or "lower", "inside" and "outside" are used to describe features of the exemplary embodiments with reference to the positions of such features as displayed in the figures.

In many respects various modified features of the various figures resemble those of preceding features and the same reference numerals followed by subscripts "a" through "g" designate corresponding parts.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method of preparing a substantially two-dimensional sheet material for bending along a plurality of bend lines to form a three-dimensional object, the method comprising the steps of:

forming a plurality of bend-facilitating structures in the sheet material along a plurality of bend lines to form at least a first panel portion and a second panel portion;

forming a fastening flange in the first panel portion substantially parallel to the second panel portion; and forming a fastening receiver in the second panel portion configured to receive a portion of the fastening flange in the first panel portion;

forming a securing button in one of the first and second panel portion; and a corresponding securing recess in the other of the first and second panel portions;

wherein the fastening flange, the fastening receiver, the securing button, and the securing recess are monolithically formed in the sheet material.

2. A method according to claim 1, wherein the fastening receiver is formed with a displaced flap extending from the second panel portion, and wherein the fastening receiver is configured to receive the fastening flange between the displaced flap and a surface of the second panel portion.

3. A method according to claim 2, wherein the fastening flap is formed with a stop edge configured to limit folding movement of the first panel portion relative to the second panel portion and to align the latch button with the latch recess.

4. A method according to claim 3, wherein the stop edge is substantially C-shaped.

5. A method according to claim 2, wherein the fastening flap is formed with a bridge portion under which the fastening flap extends, and wherein the fastening flap is formed with a latch surface which forms the latch recess.

6. A method according to claim 5, wherein the bridge portion includes at least one stop edge configured to limit folding movement of the first panel portion relative to the second panel portion and to align the latch button with the latch surface.

7. A method according to claim 5, wherein the bridge portion includes two diverging stop edges.

8. A sheet material formed by the method of claim 1.

9. A three-dimensional object formed with the sheet material of claim 1.

10. A product incorporating the three-dimensional object of claim 1.

* * * * *